US011454920B2

(12) United States Patent
Oh et al.

(10) Patent No.: US 11,454,920 B2
(45) Date of Patent: Sep. 27, 2022

(54) SUPPORT ASSEMBLY FOR SUPPORTING TONER CARTRIDGE TO BE MOUNTED OR DETACHED

(71) Applicant: Hewlett-Packard Development Company, L.P., Spring, TX (US)

(72) Inventors: Pil Seung Oh, Seongnam-si (KR); Taeil Jung, Seongnam-si (KR); Byung Woo Kim, Seongnam-si (KR); Taejin Yoon, Seongnam-si (KR)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/413,043

(22) PCT Filed: Dec. 17, 2019

(86) PCT No.: PCT/US2019/066799

§ 371 (c)(1),
(2) Date: Jun. 11, 2021

(87) PCT Pub. No.: WO2020/159633

PCT Pub. Date: Aug. 6, 2020

(65) Prior Publication Data

US 2022/0050414 A1 Feb. 17, 2022

(30) Foreign Application Priority Data

Jan. 28, 2019 (KR) ..... 10-2019-0010435

(51) Int. Cl.
*G03G 15/04* (2006.01)
*G03G 21/16* (2006.01)
(Continued)

(52) U.S. Cl.
CPC ..... *G03G 21/1647* (2013.01); *G03G 15/0889* (2013.01); *G03G 21/1814* (2013.01); *G03G 21/1864* (2013.01); *G03G 2221/1657* (2013.01)

(58) Field of Classification Search
CPC ..... G03G 15/0889; G03G 15/757; G03G 21/1647; G03G 21/1814; G03G 21/1864
See application file for complete search history.

(56) References Cited

U.S. PATENT DOCUMENTS 5,280,224 A 1/1994 Sagara
5,794,103 A 8/1998 Oh
(Continued)

FOREIGN PATENT DOCUMENTS

JP 2005-91462 A 4/2005
JP 2009-282076 A 12/2009
JP 2011-48342 A 3/2011

*Primary Examiner* — Hoang X Ngo
(74) *Attorney, Agent, or Firm* — Jefferson IP Law, LLP

(57) ABSTRACT

An example image forming apparatus includes a main body, a driving motor rotatable in a first direction to provide a driving force to a developing cartridge and rotatable in a second direction opposite to the first direction, and a support assembly to, based on the developing cartridge being mounted to the main body, provide the driving force of the driving motor in the first direction to the mounted developing cartridge, and detach the mounted developing cartridge from the main body using the driving force of the driving motor in the second direction.

15 Claims, 9 Drawing Sheets

(51) Int. Cl.
*G03G 15/08* (2006.01)
*G03G 21/18* (2006.01)

(56) References Cited

U.S. PATENT DOCUMENTS

| | | | | |
|---|---|---|---|---|
| 6,385,420 | B1 * | 5/2002 | Morioka ..... | G03G 21/1814 399/176 |
| 6,463,231 | B2 | 10/2002 | Numazu et al. | |
| 7,706,701 | B2 | 4/2010 | Wakide | |
| 8,396,379 | B2 | 3/2013 | Tsukijima | |
| 2003/0228160 | A1 | 12/2003 | Inoue et al. | |

* cited by examiner

SUPPORT ASSEMBLY FOR SUPPORTING TONER CARTRIDGE TO BE MOUNTED OR DETACHED

DESCRIPTION OF THE RELATED ART

An image forming apparatus is an apparatus for forming an image in a recording medium according to an input signal. The image forming apparatus may include a printer, a copier, a scanner, a facsimile, and a multi-function printer (MFP) integrally incorporating these functions, or the like.

An electrophotographic image forming apparatus, which is one type of image forming apparatus, includes a developing cartridge having a photosensitive drum and a developing roller, and an exposure unit. The exposure unit forms an electrostatic latent image on a surface of the photosensitive drum by scanning light onto the photosensitive drum charged with a predetermined potential, and the developing cartridge forms a visible image by supplying a toner to the photosensitive drum having the electrostatic latent image formed thereon.

The developing cartridge, which is an assembly of parts to form a visible image, may be mounted to or detached from a main body of the image forming apparatus, and is a consumable that is replaced when a life thereof elapses.

DETAILED DESCRIPTION

Hereinafter, various examples will be described with reference to the drawings. The examples described below may be modified and implemented in various different forms. In order to more clearly describe features of the examples, a detailed description of matters known to those skilled in the art will be omitted.

When the specification states that one constituent element is "connected to" another constituent element, it includes a case in which the two constituent elements are connected to each other with another constituent element intervened therebetween as well as a case in which the two constituent elements are directly connected to each other. Further, when one constituent element "comprises" or "includes" another constituent element, unless specifically stated to the contrary, it refers to a condition in which other constituent elements may be further included rather than precluding the same.

Further, the expression "image forming apparatus" as used herein may refer to an apparatus that scans an image of a document and generates a scanned image, an apparatus that prints print data generated in a terminal apparatus on a recording medium, or the like. Examples of an image forming apparatus may include a scanner, a copier, a printer, a facsimile, or a multi-function printer (MFP) implementing functions of the above. When the image forming apparatus is a copier, a printer, a scanner, a facsimile, an MFP, or the like, which is capable of the image forming job, the image forming apparatus may also be referred to as the image forming apparatus.

It should be understood that various changes can be made to examples described herein and the present disclosure can be embodied in different forms. In addition, in the following description, detailed descriptions of well-known functions or configurations will be omitted since they would unnecessarily obscure the subject matters of the present disclosure. In addition, it should be noted that the drawings as attached are to assist with an understanding of the present disclosure, and are not necessarily drawn to scale in that dimensions of some elements may be exaggerated.

In the following description, an image forming apparatus according to an example will be briefly described and a structure of a support assembly will be described in more detail.

Figure 1:
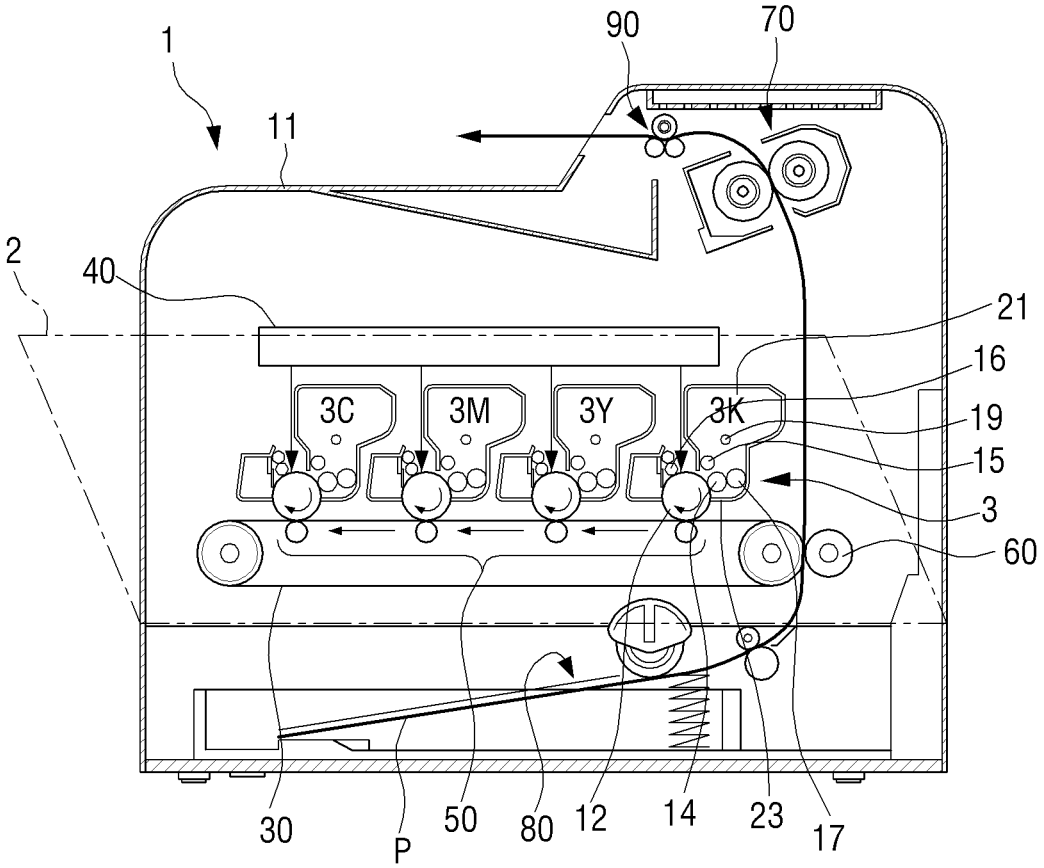
FIG. 1 is a schematic configuration diagram of an image forming apparatus according to an example.

FIG. 1 is a schematic configuration diagram of an image forming apparatus according to an example.

Referring to FIG. 1, an image forming apparatus 1 may include a main body 11 and at least one developing cartridge 3, which may be mounted to or detached from the main body 11.

In the example of FIG. 1, there are a plurality of developing cartridges 3. Each of the plurality of developing cartridges 3 may be mounted to or detached from the main body 11 by opening a door 2 located on a front surface of the main body 11. In FIG. 1, the door 2 is provided to open and close the front surface of the main body 11, but the example is not limited thereto. In other examples, the door 2 may be provided to open and close a side surface or an upper surface of the main body 11.

When toner accommodated inside a developing cartridge 3 is exhausted, each of the plurality of developing cartridge 3 may be detached from the main body 11, and a new developing cartridge 3 may be mounted to the main body 11.

The developing cartridge 3 may be supported to be mounted to or detached from the main body 11 by a support assembly that will be described later.

The plurality of developing cartridges 3 may include a plurality of developing cartridges 3C, 3M, 3Y, and 3K for developing toner of cyan (C), magenta (M), yellow (Y), and black (K) colors, respectively. However, the scope of the disclosure is not limited thereby, and the developing cartridge 3 for accommodating and developing various colors such as light magenta, white, etc., besides the aforementioned colors, may be further provided.

The developing cartridge 3 may include a toner accommodating portion 21 and a developing portion 23. Toner accommodated in the toner accommodating portion 21 may be supplied to the developing portion 23. In the toner accommodating portion 21, an agitator 19 for agitating and supplying toner to the developing portion 23 may be provided.

In the developing portion 23, a photosensitive drum 12 on which an electrostatic latent image is formed and a developing roller 14 for supplying toner to the photosensitive drum 12 may be provided. The photosensitive drum 12 is an example of a photosensitive body on which an electrostatic latent image is formed on a surface of the photosensitive drum 12, and may include a conductive metal pipe and a photosensitive layer formed on an outer circumferential surface thereof.

The surface of the photosensitive drum 12 is charged by a charging device to have a uniform surface potential. A charging roller 16 is an example of the charging device. Instead of the charging roller 16, a charging brush, a corona charger, or the like may be used. The developing roller 14 may, by being in contact with the photosensitive drum 12 and rotating, supply toner to the surface of the photosensitive drum 12. In the developing portion 23, a supplying roller 17 for supplying toner inside the developing portion 23 to the developing roller 14 may be installed.

In the developing portion 23, a developing agitator 15 for agitating toner inside the developing portion 23 may be further included. As an example, the developing agitator 15 may be a same shape as the agitator 19.

Figure 2:
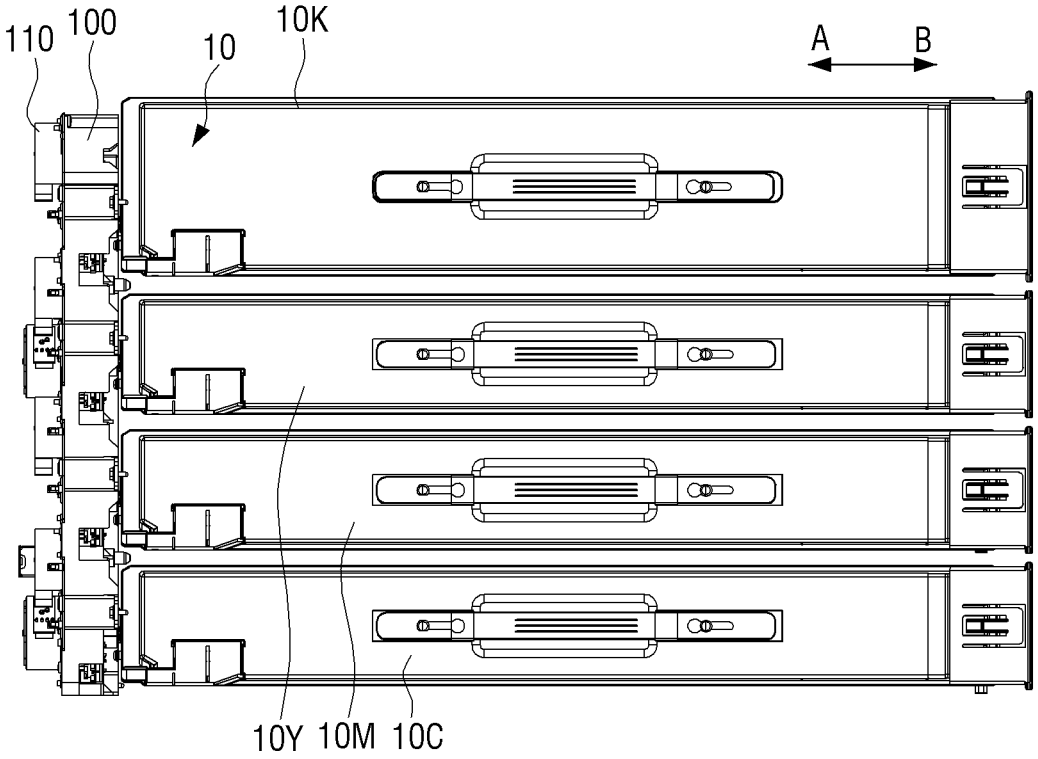
FIG. 2 is a plan view of a toner cartridge mounted to a main body illustrated in FIG. 1 according to an example.

The developing cartridge 3 of the example may be an integrated developing cartridge in which the toner accommodating portion 21 and the developing portion 23 are formed integrally. In another example, the toner accommodating portion 21 may be formed as a unit independent from the developing portion 23, such as a toner cartridge 10 (e.g., toner cartridges 10C, 10M, 10Y, and 10K) as illustrated in FIG. 2.

The charging roller 16 may charge the photosensitive drum 12 of a plurality of developing cartridges 3C, 3M, 3Y, and 3K with a uniform surface potential.

An exposure device 40 may form an electrostatic latent image on the photosensitive drum 12 by irradiating the photosensitive drum 12 with light that is modulated in accordance with image information. The exposure device 40 may respectively irradiate the photosensitive drum 12 of each of the plurality of developing cartridges 3C, 3M, 3Y, and 3K with a plurality of lights that are modulated in accordance with image information of each color, and form an electrostatic latent image on each of the photosensitive drums 12. By the C, M, Y, and K toner accommodated onto the plurality of developing cartridges 3C, 3M, 3Y, and 3K, the electrostatic latent image of the photosensitive drum 12 of the plurality of developing cartridges 3C, 3M, 3Y, and 3K is developed to visible toner images. The developed toner images are transferred to an intermediate transfer belt 30 sequentially.

The intermediate transfer belt 30 temporarily accommodates the toner image developed on the photosensitive drum 12 of the plurality of developing cartridges 3C, 3M, 3Y, and 3K. A plurality of intermediate transfer rollers 50 are disposed at a position to face the photosensitive drum 12 of the plurality of developing cartridges 3C, 3M, 3Y, and 3K with the intermediate transfer belt 30 placed therebetween.

A transfer roller 60 is located to face the intermediate transfer belt 30. In the transfer roller 60, a transfer bias to transfer the transferred toner image to a recordable medium (P) is applied.

In an example, it is described that the image developed on the photosensitive drum 12 is transferred to the intermediate transfer belt 30, and then transferred to the recordable medium (P) passing between the intermediate transfer belt 30 and the transfer roller 60. However, the example is not limited thereto, and may be configured such that the recordable medium (P) directly passes between the intermediate transfer belt 30 and the photosensitive drum 12 and the developed image is directly transferred to the recordable medium (P).

A fuser 70 may fuse the toner image on the recordable medium (P) by applying heat or pressure to the toner image transferred to the recordable medium (P).

The recordable medium (P) stacked on a feeding means 80 is fed between the transfer roller 60 and the intermediate transfer belt 30. The toner image transferred on the intermediate transfer belt 30 by the transfer bias applied to the transfer roller 60 is transferred to the recordable medium (P). When the recordable medium (P) passes the fuser 70, the toner image is fused onto the recordable medium (P) by heat and pressure. The recordable medium (P) of which fusing is completed is discharged by a discharging roller 90.

FIG. 2 is a plan view of a toner cartridge mounted to a main body illustrated in FIG. 1 according to an example.

Referring to FIG. 2, the image forming apparatus 1 may include the main body 11, at least one toner cartridge 10 that may be mounted to or detached from the main body 11, a driving motor 110 for providing a driving force to the toner cartridge 10, and a support assembly 100.

The support assembly 100 is for supporting the toner cartridge 10 to be mounted to or detached from the main body 11, and may be formed on one side of the main body 11. As an example, the support assembly 100 may be formed on a side that is opposite to the door 2 through which the toner cartridge 10 is inserted. The support assembly 100 is illustrated as a configuration separate from the main body 11, but may be integrally formed with the main body 11 as a part of the main body 11.

The toner cartridge 10 may move along a mounting direction (A) as illustrated in FIG. 2 and may be attached to the main body 11 through the support assembly 100. The toner cartridge 10 may move along a detachment direction (B) as illustrated in FIG. 2, and may be detached from the main body 11 by the support assembly 100.

The driving motor 110 may be disposed on a side of the support assembly opposite to the side from which the toner cartridge 10 may be attached to or detached from the main body 11. The driving motor 110 may provide a driving force to the toner cartridge 10 mounted through the support assembly 100.

Rotating members of the toner cartridge 10, for example, the photosensitive drum 12, the developing roller 14, the developing agitator 15, the supply roller 17, the agitator 19, or the like may be operating in connection with the driving motor 110 provided in the main body 11, when the toner cartridge 10 is mounted to the main body 11.

The driving motor 110 may be provided to drive the four toner cartridges 10, and one driving motor 110 may be disposed to each of the four toner cartridges 10, respectively. In other words, a plurality of driving motors 110 may be disposed in the image forming apparatus 1, and each of the plurality of the driving motors 110 may drive a plurality of toner cartridges 10.

When printing is performed, the driving motor 110 may rotate in a first direction, and when the toner cartridge 10 is replaced, the driving motor 110 may rotate in a second direction. When the driving motor 110 rotates in the first direction, a driving force may be provided to the toner cartridge 10 mounted to the support assembly 100, and when the driving motor 110 rotates in a second direction, the mounted toner cartridge 10 may be detached from the support assembly 100.

In addition, the driving motor 110 may rotate in the first direction during a predetermined time so as to move a pressing member to a first position after the toner cartridge 10 is detached from the main body 11.

An example of a linear movement of the pressing member between the first position and the second position according to the driving of the driving motor 110 will be described later.

The support assembly 100 may provide a driving force in the first direction of the driving motor 110 to the mounted toner cartridge 10 when the toner cartridge 10 is mounted on the main body 11, and may detach the toner cartridge 10 from the main body 11 using the driving force in the second direction of the driving motor 110.

In describing and illustrating FIGS. 1 and 2, it has been described that a plurality of toner cartridges 10 are provided on the image forming apparatus 1, but in implementation, the image forming apparatus 1 may be a mono image forming apparatus which is capable of performing mono color print only. In this case, only one toner cartridge 10 may be provided.

Hereinafter, an example configuration of a support assembly and an example of a mounting and detaching processes of a toner cartridge by a support assembly will be described.

Figure 3:
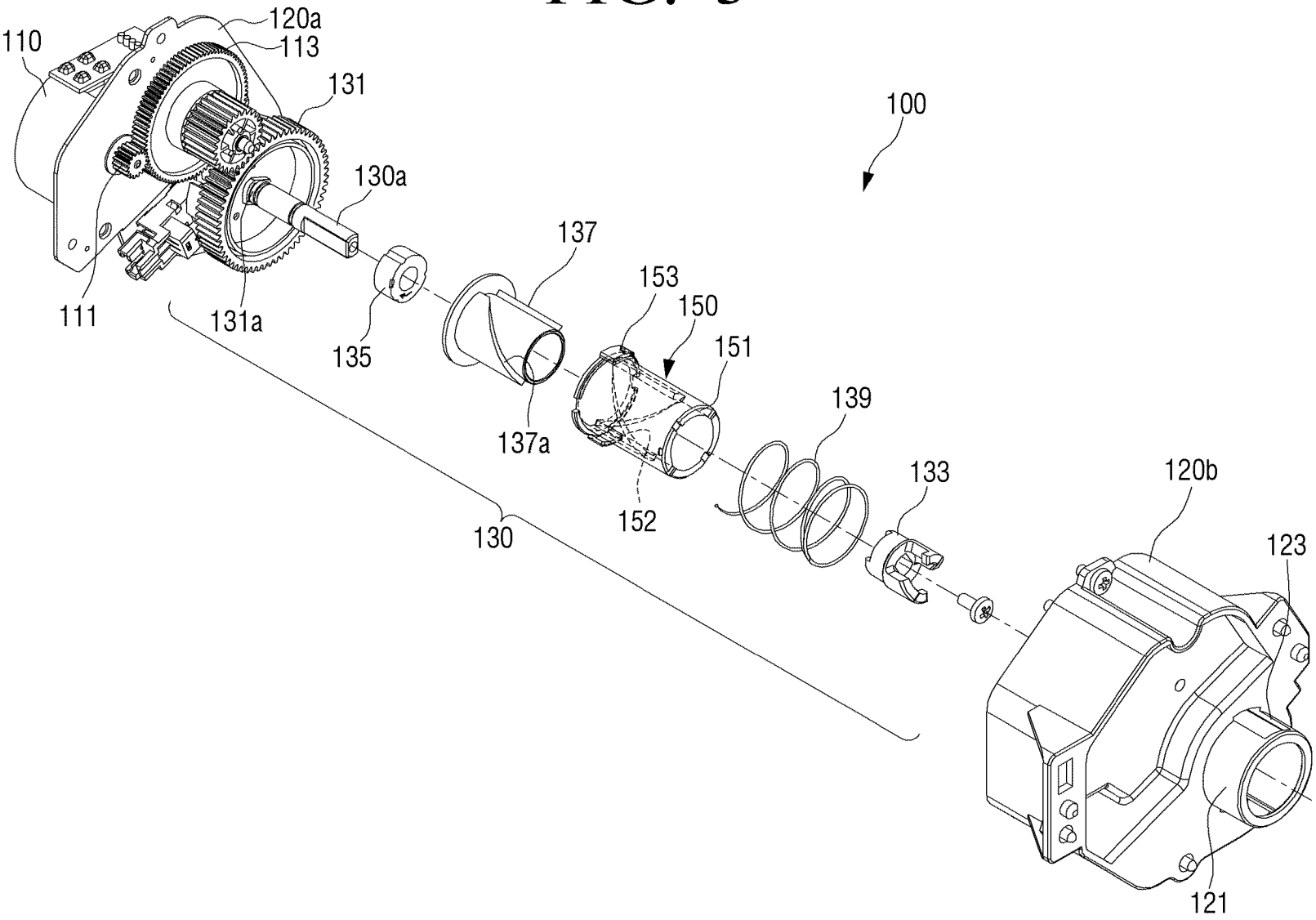
FIG. 3 is an exploded perspective view of a support assembly according to an example.

FIG. 3 is an exploded perspective view of a support assembly according to an example.

Referring to FIG. 3, the support assembly 100 may include a support housing 120, a pressing member 150 to press the toner cartridge 10 in the detachment direction (B), and a driving force transfer member 130 for selectively transferring the driving force of the driving motor 110 to the pressing member 150.

The support housing 120 may form an outer shape of the support assembly 100 and support the toner cartridge 10. The toner cartridge 10 may be connected to a main body (e.g., the main body 11 of FIG. 1), to be mounted and detached.

The support housing 120 may be composed of a first support housing 120*a* and a second support housing 120*b*. The first support housing 120*a* and the second support housing 120*b* may form a space in which the pressing member 150 and the driving force transfer member 130 may be disposed.

At one end of the first support housing 120*a*, opposite the second support housing 120*b*, the driving motor 110 may be disposed. The driving force supplied from the driving motor 110 may be transferred to the driving force transfer member 130 through a motor gear 111 and a connecting gear 113.

The pressing member 150 may be provided to linearly move between a first position, in which the pressing member 150 is disposed inside the support housing 120, and a second position, in which the pressing member 150 is disposed to protrude toward the detachment direction (B) from the support housing 120. Here, the first position is a position of disposing the pressing member 150 inside the support housing 120 and the second position is a position of disposing the pressing member 150 to protrude at an outer side of the support housing 120. An example of the pressing member 150 in the first position will be described below with reference to FIG. 4A and an example of the pressing member 150 in the second position will be described below with reference to FIG. 4B.

The pressing member 150 may selectively receive the driving force of the driving motor 110 from the driving force transfer member 130 to be described later. The pressing member 150 may move from the first position to the second position by the driving force transferred from the driving force transfer member 130 and press the toner cartridge 10 in the detachment direction (B).

The pressing member 150 disposed at the second position may move to the first position by the rotation of the driving motor 110 in the first direction and an elastic member 139 to be described later.

The pressing member 150 may include a pressing surface 151 which may be in contact with the toner cartridge 10. The pressing surface 151 may be formed on a side of the pressing member 150 and may press the toner cartridge 10 in the detachment direction (B) when the toner cartridge 10 is detached.

The driving force transfer member 130 may selectively transfer the driving force of the driving motor 110 to the pressing member 150 and move the pressing member 150 in the detachment direction (B) when the toner cartridge 10 is replaced.

The driving force transfer member 130 may include a driving gear 131 which rotates by receiving the rotational force from the driving motor 110, a shaft 130*a* which is rotatably coupled to the driving gear 131, a driving coupler 133 which is connected to the shaft 130*a* and may be coupled to the toner cartridge 10, a bearing 135 for selectively transferring the rotational force of the driving gear 131 to the pressing member 150, and a shifting member 137 to shift the rotational movement of the bearing 135 to a linear movement of the pressing member 150.

The driving gear 131 may be disposed to be engaged with the connecting gear 113 connected to the driving gear 131 of the driving motor 110. The driving gear 131 may receive the driving force from the driving motor 110 and rotate in a first direction or a second direction according to a rotation direction of the driving motor 110.

The shaft 130*a* may be coupled to the driving gear 131 to be rotated along with the driving gear 131. The shaft 130*a* may be fixedly coupled to a rotational axis of the driving gear 131. At a rotational axis of the driving gear 131, a D-cut part 131*a* may be provided. And, in the shaft 130*a*, a shape which is complementary with the D-cut part 131*a* may be provided.

It has been described that the driving gear 131 and the shaft 130*a* are connected by the D-cut part, but the example is not limited thereto. The driving gear 131 and the shaft 130*a* may be connected in any of various manners to rotate in the same direction. For example, the driving gear 131 and the shaft 130*a* may be connected via a pin.

Accordingly, the shaft 130*a* may rotate in the first direction along with the driving gear 131, when the driving gear 131 rotates in the first direction, and may rotate in the second direction along with the driving gear 131, when the driving gear 131 rotates in the second direction.

The shaft 130*a* connected to the driving gear 131 to transfer the driving force of the driving motor 110 may rotate the driving coupler 133, which is coupled to the shaft 130*a*. When the toner cartridge 10 is coupled to the main body 11, the toner cartridge 10 may be fixed on a mounting position by the rotation of the driving coupler 133 in the first direction, and the toner cartridge 10 may be separated by the rotation of the driving coupler 133 in the second direction.

One side of the driving coupler 133 may be coupled to the shaft 130*a* and the other side may be coupled to the toner cartridge 10. When the toner cartridge 10 is coupled to the main body 11, the driving force of the driving motor 110 may be transferred to the toner cartridge 10 through the driving coupler 133, so as to drive the toner cartridge 10.

The driving force transfer member 130 may include the bearing 135 to selectively provide a driving force of the driving motor 110 to the pressing member 150, that is, to transfer a rotational force in the second direction only.

The bearing 135 may be installed on the shaft 130*a* and positioned between the shifting member 137 in contact with the pressing member 150 and the shaft 130*a*. Here, the bearing 135 may be implemented with a one-way bearing. In the example, it has been described that the bearing 135 is a one-way bearing, but the example is not limited thereto. The bearing 135 may be implemented with various configurations capable of transferring only a one-way driving force of the driving motor 110.

The bearing 135 may be positioned between the shaft 130*a* and the shifting member 137. When the shaft 130*a* rotates in the first direction, the bearing 135 enables the shifting member 137 to slip with respect to the shaft 130*a*. In this case, the shifting member 137 may rotate independently of the shaft 130*a*. That is, when the driving motor 110 rotates in the first direction, the shifting member 137 does not rotate along with the shaft 130*a* and does not transfer the rotational force of the driving motor 110 to the pressing member 150.

In contrast, when the shaft 130*a* rotates in the second direction, the bearing 135 enables the shifting member 137 to rotate along with the shaft 130*a*. That is, when the driving motor 110 rotates in the second direction, the shifting member 137 may rotate along with the shaft 130*a* and transfer the rotational force of the driving motor 110 to the pressing member 150.

The driving force transfer member 130 may include the shifting member 137 for moving the pressing member 150 to the second position and a guide member 121 for enabling the pressing member 150 to linearly move between the first position and the second position.

The pressing member 150 may be disposed between the shifting member 137 and the guide member 121 and move between the first position and the second position.

The shifting member 137 may be provided to receive rotational force from the bearing 135 selectively and rotate along with the bearing 135.

The shifting member 137 may have a guide surface 137*a* formed in an outer surface which is in contact with the pressing member 150, and the pressing member 150 may have a support surface 152 which is complementary with the guide surface 137*a* formed in an inner surface.

The guide surface 137*a* of the shifting member 137 and the support surface 152 of the pressing member 150 may be formed to be inclined from each other. The guide surface 137*a* may be formed to be upwardly inclined in the detachment direction (B) to guide the pressing member 150 to linearly move.

The guide surface 137*a* may protrude toward the outward direction from the shifting member 137 and have a curvature along the outer circumferential surface of the shifting member 137. The support surface 152 may be formed in the inner surface of the pressing member 150 to protrude inwardly, and may be formed to face the guide surface 137*a*.

An example has been described in which the guide surface 137*a* of the shifting member 137 and the support surface 152 of the pressing member 150 are formed to be inclined from each other. However, in other examples, the shifting member 137 and the pressing member 150 may be formed in diverse forms so that the pressing member 150 may linearly move by the rotational movement of the shifting member 137. For example, an inclined guide surface may be formed on only one of the shifting member 137 and the pressing member 150.

The guide member 121 may be formed to protrude on a side of the second support housing 120*b*. The guide member 121 may include a guide groove 123 which is formed in a linear and extended manner in the mounting direction (A) to guide the pressing member 150 to move linearly.

A guide protrusion 153 formed on the outer surface of the pressing member 150 may be inserted into the guide groove 123 for guiding the pressing member 150 to linearly move.

The pressing member 150 may linearly move between the first position and the second position by the shifting member 137 and the guide member 121.

The shifting member 137 may be connected to the bearing 135 and rotate. The shifting member 137 may move the pressing member 150 to the second position in accordance with rotation of the bearing 135. For example, when the driving gear rotates in the first direction, the bearing 135 may maintain the pressing member 150 to be in the first position by enabling the shifting member 137 to slip with respect to the shaft 130*a*.

On the contrary, when the driving gear 131 rotates in the second direction, the bearing 135 may rotate in the second direction and the shifting member 137 may rotate together with the bearing 135. In that case, the shifting member 137 may transfer the rotational force in the second direction to the pressing member 150. The pressing member 150 may move between the first position and the second position by the transferred rotational force in the second direction of the shifting member 137 and the guide of the guide member 121.

The elastic member 139 may be provided between the guide member 121 and the pressing member 150. The elastic member 139 may provide an elastic force to the pressing member 150 in the mounting direction (A) of the toner cartridge 10.

The elastic member 139 may move the pressing member 150 to the first position by pressing the pressing member 150 in the mounting direction (A).

The driving motor 110 may rotate in the first direction to move the pressing member 150 disposed at the second position to the first position. Accordingly, when the driving gear 131 rotates in the first direction, the shifting member 137 may rotate independently, as the shaft 130*a* slips. The shifting member 137 may rotate in the first direction by the elastic force for the mounting direction (A) of the elastic member 139, and the pressing member 150 may move to the first position by the rotation of the shifting member 137 in the first direction.

When the toner cartridge 10 is mounted to the main body 11, the pressing force is applied to the pressing surface 151 of the pressing member 150 positioned at the second position in the mounting direction (A), and the pressing member 150 may move to the first position by the guide member 121. As an example, the guide protrusion 153 of the pressing member 150 may move to the first position along the guide groove 123 of the guide member 121.

Figure 4A:
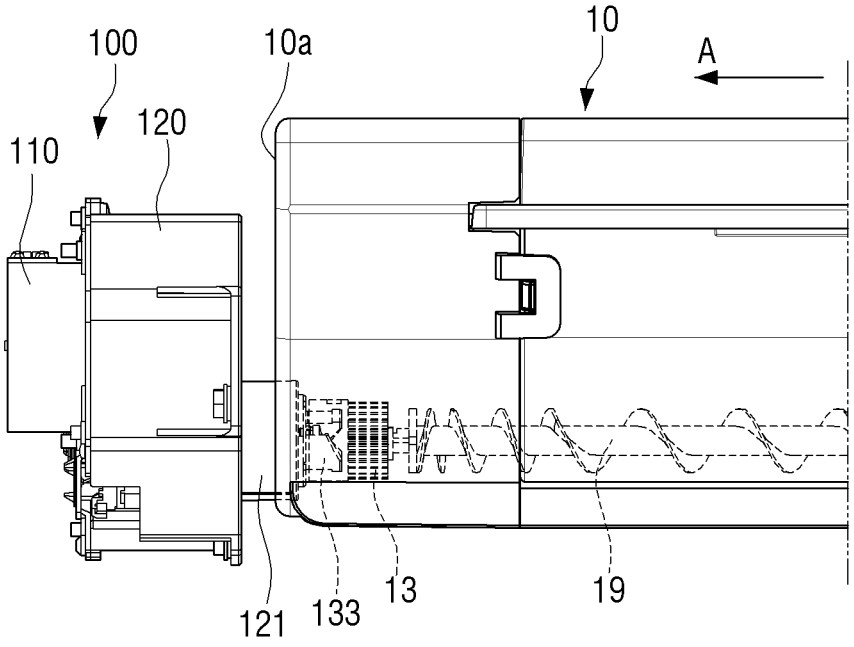
FIG. 4A is a side view of a support assembly and a toner cartridge illustrating a state in which the toner cartridge is positioned at a mounting position according to an example.
Figure 4B:
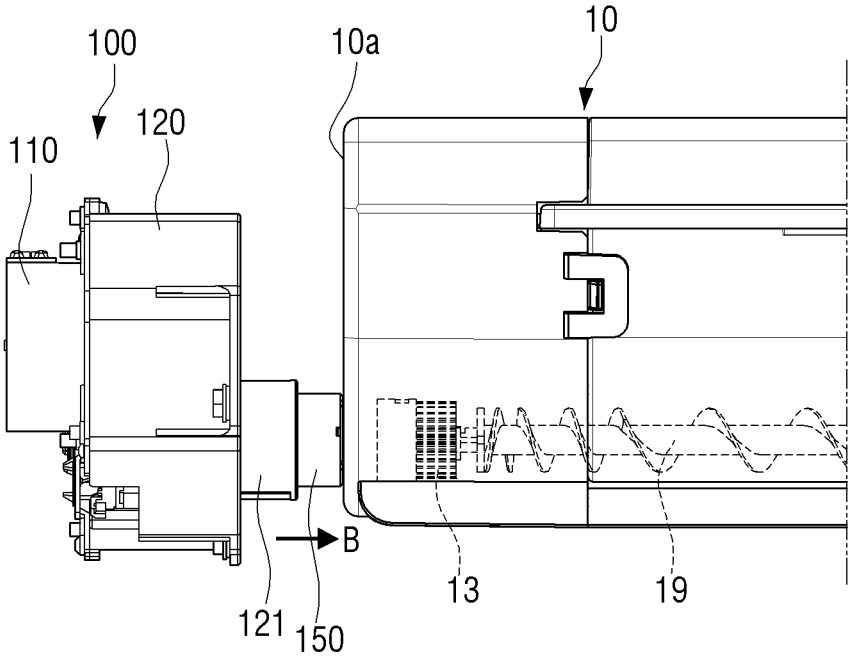
FIG. 4B is a side view of the support assembly and the toner cartridge illustrating a state in which the toner cartridge is positioned at a detachment position according to an example.

Referring to FIGS. 4A and 4B, an example operation of a support assembly will be described.

FIG. 4A is a side view of a support assembly and a toner cartridge illustrating a state in which the toner cartridge is positioned at a mounting position according to an example, and FIG. 4B is a side view of the support assembly and the toner cartridge illustrating a state in which the toner cartridge is positioned at a detachment position according to an example.

Referring to FIG. 4A, the toner cartridge 10 may move in the mounting direction (A) and be mounted to the main body 11 through the support assembly 100.

The toner cartridge 10 may be mounted to one side of the support assembly 100, and receive the driving force from the driving motor 110 disposed at the other side of the support assembly 100.

When the toner cartridge 10 is mounted to the main body 11, the pressing member 150 may move to the first position by the pressing force applied to the pressing surface 151 in the mounting direction (A). That is, the pressing member 150 may be located inside the support housing 120.

The driving coupler 133 may be exposed to the outside of the support housing 120, and the exposed driving coupler 133 and a locking member 13 of the toner cartridge 10 may be coupled. The locking member 13 may be exposed to a mounting surface 10*a* of the toner cartridge 10 to be coupled to the driving coupler 133.

When the toner cartridge 10 is mounted to the main body 11, the driving coupler 133 may be connected to the driving motor 110 and transfer the driving force of the driving motor 110 to the toner cartridge 10.

The locking member 13 may be connected with the rotating members of the toner cartridge 10, for example, the agitator 19, the developing roller 14, the supply roller 17, the developing agitator 15, and gears which are not illustrated. The locking member 13, for example, may be positioned on the same axis as the rotational axis of the agitator 19.

When the toner cartridge 10 is mounted to the main body 11, the driving coupler 133 may be locked and coupled with the locking member 13 by the rotation of the driving motor 110 in the first direction.

While the toner cartridge 10 is mounted to the main body 11 by the support assembly 100, the driving motor 110 rotates in the first direction during an image forming job. The rotational force of the driving motor 110 in the first direction may be transferred to the toner cartridge 10 through the driving coupler 133.

The rotational members of the toner cartridge 10, for example, the agitator 19 may be connected to the driving motor 110 provided to the main body 11 for driving, when the toner cartridge 10 is mounted to the main body 11. When the driving motor 110 rotates in the first direction, the agitator 19 may rotate by the rotation of the driving gear 131. The developing roller 14, the developing agitator 15, the supply roller 17, or the like, which are the rotational members of the toner cartridge 10, may be connected to the agitator 19 for rotating.

At this time, the driving force transfer member 130 does not transfer the rotational force of the driving motor 110 in the first direction to the pressing member 150 by the bearing 135. The pressing member 150 maintains the state where the pressing member 150 is positioned at the first position. The toner cartridge 10 may be supported by the support assembly 100, while the toner cartridge 10 is being mounted to the main body 11, during the image forming process.

Referring to FIG. 4B, in the case of removing the toner cartridge 10, the toner cartridge 10 should be moved to the detachment direction (B). By the movement of the pressing member 150 to the second position, the toner cartridge 10 may be separated from the main body 11.

In an example, the driving motor 110 may rotate in the second direction, and the driving coupler 133 may release locking with the locking member 13 by the rotation of the driving motor 110 in the second direction.

The rotational force of the driving motor 110 in the second direction may be transferred to the pressing member 150 by the driving force transfer member 130 for moving the pressing member 150 to the detachment direction (B). By the movement of the pressing member 150 to the second position, the pressing force in the detachment direction (B) may be applied to the mounting surface 10*a* of the toner cartridge 10.

The toner cartridge 10 may be separated from the main body 11 by the pressing member 150.

When the pressing member 150 moves to the second position for separating the toner cartridge 10 from the main body 11, the driving motor 110 may stop rotation in the second direction. Thereby, the toner cartridge 10 may be supported by the support assembly 100 to be mounted to or detached from the main body 11.

In order to move the pressing member 150 located at the second position back to the first position, the driving motor 110 may rotate in the first direction during a predetermined time. Thereby, the pressing member 150, which receives a pressing force in the mounting direction (A) by the elastic member 139, may move to the first position by the rotation in the first direction of the freely rotatable shifting member 137.

The support assembly 100 may separate the toner cartridge 10 from the main body 11 using the rotational force of the driving motor 110 in the second direction. The replacement of the toner cartridge 10 is made easier by this structure, and replacement, repair, and maintenance of the toner cartridge 10 may be more easily performed.

The support assembly 100 may be formed as one configuration of the main body 11 which is coupled with the toner cartridge 10 and thus, the image forming apparatus 1 may be compact.

Hereinbelow, with reference to FIGS. 5 and 6, an example of a driving operation of a pressing member will be described.

Figure 5:
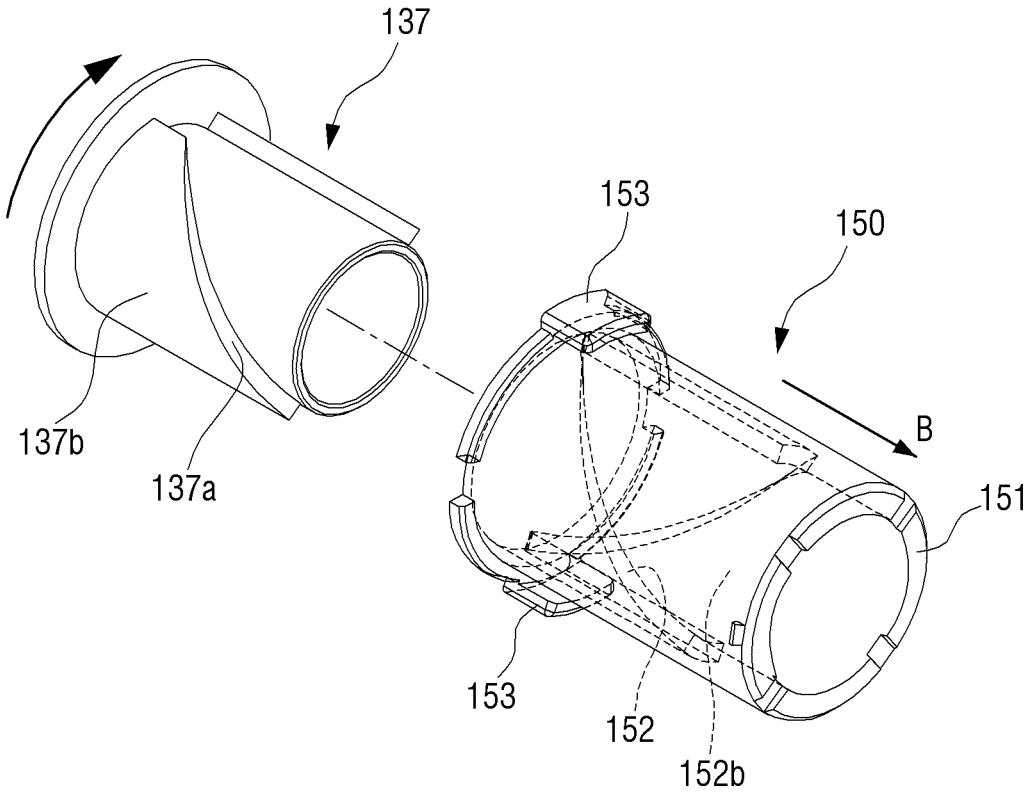
FIG. 5 is an exploded perspective view of a shifting member and a pressing member according to an example.
Figure 6:
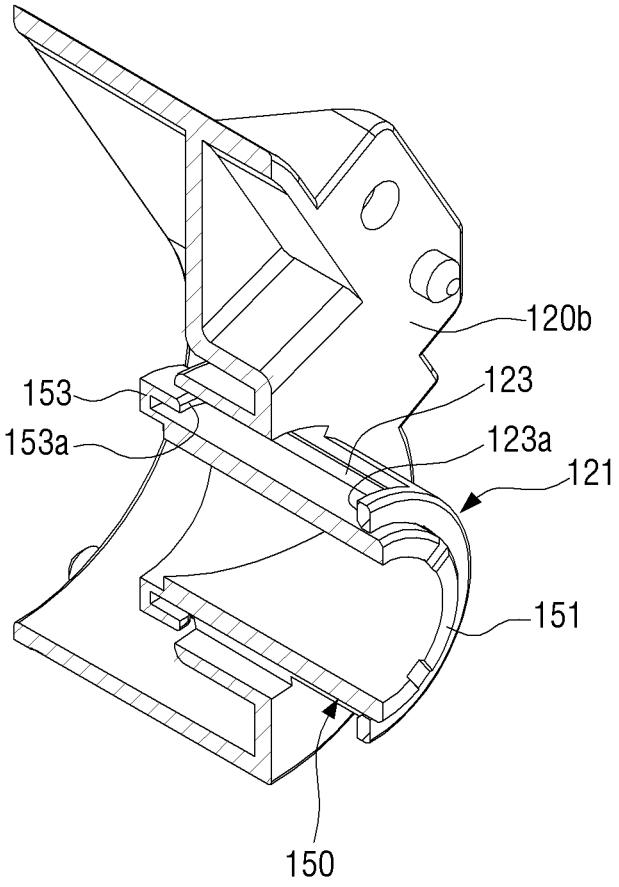
FIG. 6 is a cut-away perspective view along a guide groove of a guide member according to an example.

FIG. 5 is an exploded perspective view of a shifting member and a pressing member according to an example, and FIG. 6 is a cut-away perspective view along a guide groove of a guide member according to an example.

With reference to FIGS. 5 and 6, an example coupling relation between the pressing member 150 with the shifting member 137 and the guide member 121 will be described.

Referring to FIG. 5, the pressing member 150 may be shifted between the first position in which the toner cartridge 10 is maintained to be mounted to the main body 11, and the second position in which the toner cartridge 10 is moved to the detachment position when the replacement of the toner cartridge 10 is necessary. The shifting member 137 may move the pressing member 150 in the detachment direction (B).

The shifting member 137 is rotated by being connected to the bearing 135. The shifting member 137 may linearly move the pressing member 150 to the second position according to the rotation of the bearing 135 in the second direction.

In an outer side of the shifting member 137, the guide surface 137*a*, which is formed to be upwardly inclined in the detachment direction (B), may be provided. In an inner side of the pressing member 150, a support surface 152, which moves in the detachment direction (B) along with the guide surface 137*a*, may be provided.

The support surface 152 may be positioned to face the guide surface 137*a*. Accordingly, the support surface 152 may directly receive the rotational force of the guide surface 137*a* in the second direction.

A guide portion 137*b* formed with the guide surface 137*a* may be formed to protrude to have a predetermined width in an outer side direction of the shifting member 137. A support portion 152*b* formed with the support surface 152 may be formed to protrude to have a predetermined width in an inner side direction of the pressing member 150 in a complementary manner to the guide portion 137*b*. The support portion 152*b* may be inserted and disposed to one side of the shifting member 137 in which the guide portion 137*b* is not formed.

An example has been described in which the shifting member 137 includes the guide surface 137*a*. However, the example is not limited thereto, and the shifting member 137 may be configured to shift the rotational movement of the shifting member 137 to the linear movement of the guide member 121.

Referring to FIG. 6, the pressing member 150 may have a guide protrusion 153 to linearly move along the shaft 130*a* on the shaft 130*a* of the driving force transfer member 130.

The guide protrusion 153 may be inserted into the guide groove 123 formed on the guide member 121 and linearly mode along the guide groove 123.

The guide groove 123 may be formed on the guide member 121 which is formed to protrude in the detachment direction (B) on the second support housing 120*b*. The guide groove 123 may be extensively formed in a linear manner along the guide member 121.

The pressing member 150 may linearly move between the first position and the second position by the guide member 121.

When the pressing member 150 is located at the second position, one side 123*a* of the guide groove 123 may restrict one end 153*a* of the guide protrusion 153 so that the pressing member 150 is located at the second position.

As the one end 153*a* of the guide protrusion 153 is supported by the one side 123*a* of the guide groove 123, it may be prevent a problem in which the pressing member 150 is spaced apart from the guide member 121.

The pressing member 150 may linearly move in the detachment direction (B) by the rotation of the shifting member 137 in the second direction (a direction of an arrow in FIG. 5).

In an example, by the guide surface 137*a* of the shifting member 137 which rotates in the second direction, the support surface 152 of the pressing member 150 may receive the rotational force in the second direction. In this case, the guide protrusion 153 is inserted into the guide groove 123 and performs only linear movement in the mounting direction (A) or the detachment direction (B) along the guide groove 123 and thus, the pressing member 150 may linearly move in the detachment direction (B) by the rotational force in the second direction received from the shifting member 137. That is, the pressing member 150 may linearly move in the detachment direction (B), as the support surface 152 of the pressing member 150 moves in the detachment direction (B) along the guide surface 137*a* of the shifting member 137 which rotates.

That is, the pressing member 150 may move in the detachment direction (B) and may be positioned at the second position by the shifting member 137 and the guide member 121.

Figure 7A:
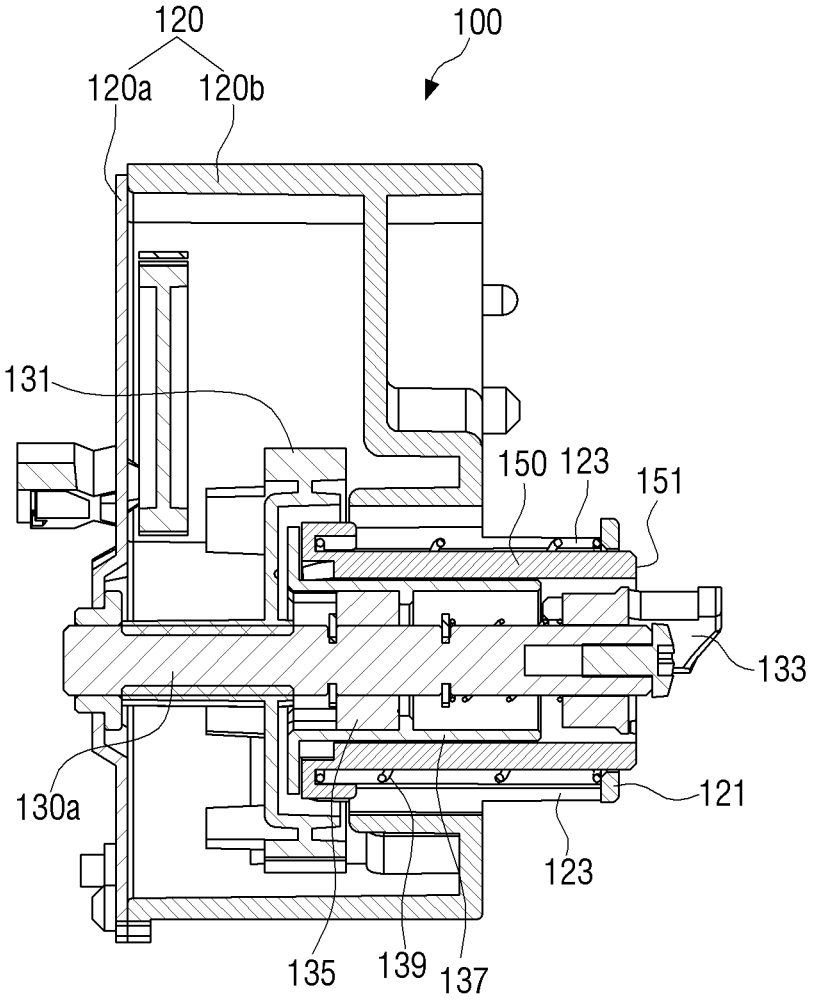
FIG. 7A is a sectional view of a support assembly illustrating a state in which a pressing member is positioned at a first position according to an example.
Figure 7B:
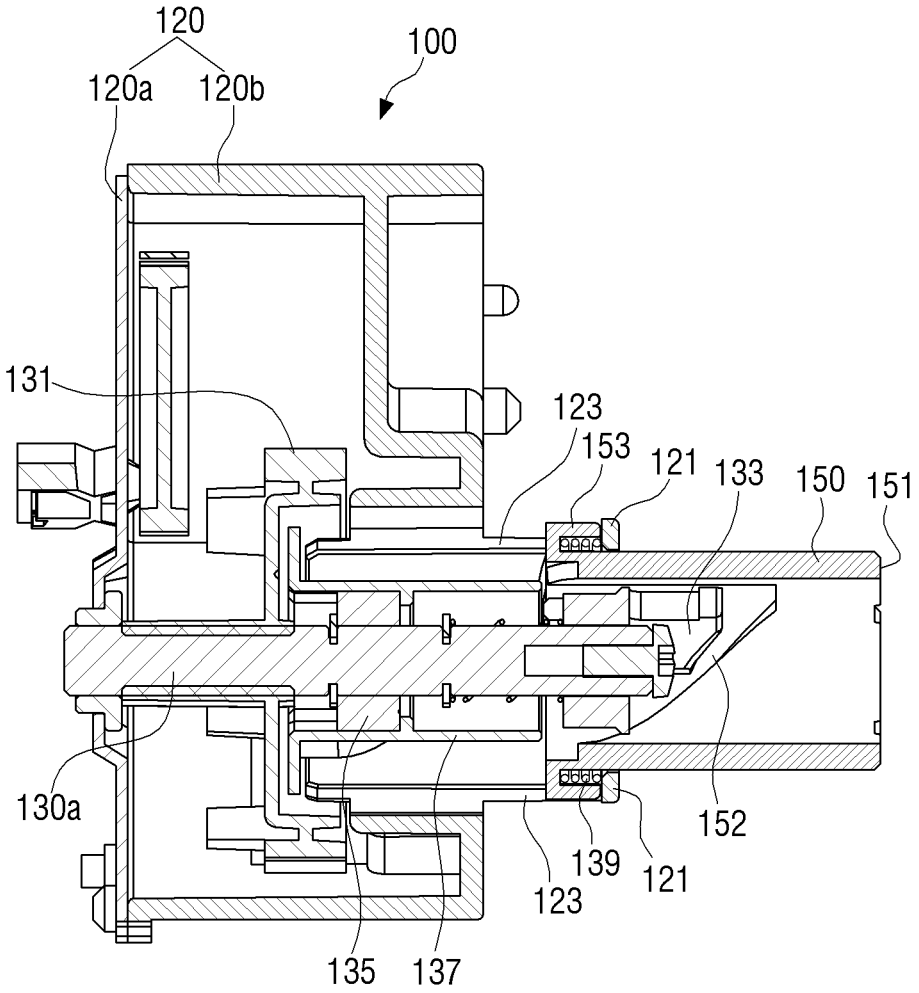
FIG. 7B is a sectional view of a support assembly illustrating a state in which a pressing member is positioned at a second position according to an example.

FIG. 7A is a sectional view of a support assembly illustrating a state in which a pressing member is positioned at a first position according to an example, and FIG. 7B is a sectional view of a support assembly illustrating a state in which a pressing member is positioned at a second position according to an example.

Referring to FIGS. 7A and 7B, the pressing member 150 may be disposed on the support assembly 100 to be linearly movable between the first position and the second position.

Referring to FIG. 7A, the toner cartridge 10 may be mounted on the main body 11 through the support assembly 100. In FIG. 7A, the toner cartridge 10 connected to the driving coupler 133 of the support assembly 100 is omitted for convenient description.

When the toner cartridge 10 is mounted to the support assembly 100, the pressing member 150 may be positioned in the first position. As the pressing member 150 is positioned inside the support housing 120, the driving coupler 133 may be exposed to the outside of the support assembly 100. The driving coupler 133 exposed to the outside may be coupled with the toner cartridge 10. As an example, the driving coupler 133 may be coupled with the locking member 13 of the toner cartridge 10 and transfer the driving force of the driving motor 110 to the toner cartridge 10.

When the toner cartridge 10 is mounted to the support assembly 100, the driving motor 110 may rotate in the first direction when the image is formed. By the rotation of the driving motor 110 in the first direction, the driving motor 110 and the driving gear 131, which is connected by the motor gear 111 and the connecting gear 113, may rotate in the first direction.

By the rotation of the driving gear 131 in the first direction, the shaft 130*a* and the driving coupler 133 may rotate, together, in the first direction. The driving coupler 133 may rotate in the first direction and be fixedly coupled to the locking member 13 of the toner cartridge 10. Accordingly, the rotational force of the driving motor 110 in the first direction may be transferred to the toner cartridge 10 through the driving coupler 133 to move the toner cartridge 10.

When the driving motor 110 rotates in the first direction, the toner cartridge 10 has to be maintained in a mounted state and thus, the rotational force of the driving motor 110 is not transferred to the pressing member 150.

As an example, the bearing 135 connected to the shaft 130*a* enables the shifting member 137 to slip with respect to the shaft 130*a*, when the driving motor 110 rotates in the first direction. Accordingly, when the driving motor 110 rotates in the first direction, the shifting member 137 does not rotate with the shaft 130*a*, and does not transfer the rotational force to the pressing member 150. The pressing member 150 may be maintained at the first position.

Referring to FIG. 7B, the toner cartridge 10 may be disposed to be apart from the main body 11 by a predetermined distance by the pressing member 150 which moves to the second position. As an example, the pressing member 150 may be located by moving to protrude from the inside of the support housing 120 to the outside of the support housing 120.

As the pressing member 150 is positioned to protrude to the outside of the support housing 120, the pressing surface 151 may press the toner cartridge 10 in the detachment direction (B) and move the toner cartridge 10 to be apart from the main body 11. In this case, the driving coupler 133 may be located inside the pressing member 150 located at the second position.

When the replacement of the toner cartridge 10 is necessary, the driving motor 110 may rotate in the second direction. By the rotation of the driving motor 110 in the second direction, the driving gear 131 connected to the driving motor 110 may rotate in the second direction.

By the rotation of the driving gear 131 in the second direction, the shaft 130*a* and the driving coupler 133 may rotate together in the second direction. By the rotation of the driving coupler 133 in the second direction, the locking coupling of the toner cartridge 10 with the locking member 13 may be released. Accordingly, the rotational force of the driving motor 110 is no longer transferred to the toner cartridge 10.

When the driving motor 110 rotates in the second direction, the pressing member 150 may linearly move to the second position to detach the toner cartridge 10.

As an example, the bearing 135 connected to the shaft 130*a* enables the shifting member 137 to rotate in the second direction along with the shaft 130*a*, when the shaft 130*a* rotates in the second direction. That is, by the rotation of the driving motor 110 in the second direction, the shifting member 137 rotates along with the shaft 130*a* to move the pressing member 150 in the detachment direction (B).

By rotation of the shifting member 137, the pressing member 150 may linearly move to the second position along the guide groove 123 of the guide member 121. The guide member 121 may be positioned at the second position and limit movement beyond the guide member 121 of the guide protrusion 153 inserted into the guide groove 123.

The pressing member 150 positioned at the second position may support the toner cartridge 10 to be detached from the main body 11.

The elastic member 139, positioned between the guide protrusion 153 and the guide groove 123, may provide the elastic force to the guide member 121 in the mounting direction (A).

For replacement of a toner cartridge, the pressing member 150 may move from the second position to the first position again. For this purpose, the driving motor 110 may rotatably drive in the first direction for a predetermined time. The pressing member 150 may move to the first position by idle rotation of the shifting member 137 according to the elastic force of the elastic member 139 in the mounting direction (A) and rotation of the driving motor 110 in the first direction.

As an example, the shifting member 137 may slip with respect to the shaft 130*a* by the bearing 135 by the rotation of the driving motor 110 in the first direction and rotate freely in an independent manner. By the pressing member 150 which receives the pressing force in the mounting direction (A) by the elastic member 139, the shifting member 137 may rotate in the first direction. And by the rotation of the shifting member 137 in the first direction, the pressing member 150 may move to the first position.

The support assembly 100 may automatically detach the toner cartridge 10 from the main body 11, when the replacement of the toner cartridge 10 is necessary using the existing driving motor 110. The support assembly 100 may improve user convenience by automatically detaching the driving cartridge 10. Also, the support assembly 100 is more easily manufactured by using the existing driving motor 110 and having a simple structure.

The foregoing examples are not to be construed as limiting the present disclosure. Rather, the present teaching can be readily applied to other types of apparatuses. Also, the description of the examples of the present disclosure is intended to be illustrative, and not to limit the scope of the claims, and many alternatives, modifications, and variations will be apparent to those skilled in the art.

What is claimed is:

1. An image forming apparatus comprising:

a main body;

a driving motor rotatable in a first direction to provide a driving force to a toner cartridge and rotatable in a second direction opposite to the first direction; and a support assembly to:

based on the toner cartridge being mounted to the main body, provide the driving force of the driving motor in the first direction to the mounted toner cartridge, and detach the mounted toner cartridge from the main body using the driving force of the driving motor in the second direction.

2. The image forming apparatus of claim 1, wherein the support assembly comprises:

a support housing;

a pressing member to linearly move between a first position in which the pressing member is disposed inside the support housing and a second position in which the pressing member projects from the support housing, the pressing member being disposed outside the support housing; and a driving force transfer member to rotate by receiving driving force from the driving motor and to transfer the driving force to the pressing member when the driving motor rotates in the second direction.

3. The image forming apparatus of claim 2, wherein the pressing member is to linearly move to the first position by mounting of the toner cartridge and to linearly move to the second position by rotation of the driving motor in the second direction.

4. The image forming apparatus of claim 3, wherein the pressing member comprises a pressing surface capable of being in contact with a mounting surface of the toner cartridge.

5. The image forming apparatus of claim 2, wherein the driving force transfer member comprises:

a driving gear to rotate by receiving the driving force from the driving motor;

a shaft to rotatably couple to the driving gear;

a driving coupler of which one side is to couple to the shaft and another side is to couple to the toner cartridge;

a bearing to couple to the shaft to selectively transfer a rotational force of the driving gear to the pressing member;

a shifting member to rotatably couple between the bearing and the pressing member to shift the rotational force to a linear movement of the pressing member; and a guide member formed at the support housing and fixedly positioned at an outside of the pressing member to guide a linear movement of the pressing member.

6. The image forming apparatus of claim 5, wherein the pressing member is disposed to be linearly movable between the first position and the second position between the shifting member and the support housing.

7. The image forming apparatus of claim 6, further comprising:

an elastic member disposed between the pressing member and the support housing to provide an elastic force to the pressing member in a mounting direction of the toner cartridge.

8. The image forming apparatus of claim 6, wherein a guide protrusion protrudes from an outer side of the pressing member, and wherein a guide groove extends on an inner side of the housing in a linear direction to guide the pressing member to linearly move.

9. The image forming apparatus of claim 5, wherein the shifting member comprises a guide surface on an outer surface to guide the pressing member to linearly move.

10. The image forming apparatus of claim 9, wherein the guide surface is inclined upwardly in a detachment direction of the toner cartridge.

11. The image forming apparatus of claim 5, wherein the pressing member comprises a support surface on an inner surface to guide the toner cartridge to move in the mounting direction by rotation of the shifting member in the second direction.

12. The image forming apparatus of claim 5, wherein the toner cartridge comprises:

a locking member to fixedly couple to the driving coupler at a first position in which the toner cartridge is mounted to the main body.

13. The image forming apparatus of claim 12, wherein the driving coupler is to transfer the driving force of the driving motor to the toner cartridge through the locking member.

14. The image forming apparatus of claim 1, wherein the driving motor is to rotate in the first direction when printing is performed, and the driving motor is to rotate in the second direction when the toner cartridge is replaced.

15. A support assembly to support a toner cartridge detachably mounted to an inside of a main body of an image forming apparatus, the support assembly comprising:

a driving motor; and a support housing, wherein the support assembly is to, based on the toner cartridge being mounted to the main body, provide a driving force of the driving motor to the toner cartridge in a first direction, and detach the mounted toner cartridge from the main body using the driving force of the driving motor in a second direction.

* * * * *